US007755471B2

(12) United States Patent
Jackson

(10) Patent No.: US 7,755,471 B2
(45) Date of Patent: Jul. 13, 2010

(54) MOTION SENSITIVE SELF-CONTAINED AUDIO MODULE FOR WARNING SIGNS

(76) Inventor: Shawn Jackson, 1337 Lakeview Dr., Virginia Beach, VA (US) 23455-4146

( * ) Notice: Subject to any disclaimer, the term of this patent is extended or adjusted under 35 U.S.C. 154(b) by 814 days.

(21) Appl. No.: 11/164,281

(22) Filed: Nov. 17, 2005

(65) Prior Publication Data

US 2006/0132322 A1 Jun. 22, 2006

Related U.S. Application Data

(60) Provisional application No. 60/629,015, filed on Nov. 18, 2004.

(51) Int. Cl.
*G08B 3/00* (2006.01)

(52) U.S. Cl. ..... 340/384.1; 340/552

(58) Field of Classification Search ..... 340/384.1, 340/539.27, 552, 561, 565; 40/455, 717
See application file for complete search history.

(56) References Cited

U.S. PATENT DOCUMENTS 4,951,045 A * 8/1990 Knapp et al. ..... 340/944
4,954,813 A * 9/1990 August et al. ..... 340/571
5,077,548 A * 12/1991 Dipoala ..... 340/522
5,117,217 A * 5/1992 Nykerk ..... 340/426.23
5,986,540 A * 11/1999 Nakagaki et al. ..... 340/384.7
6,003,257 A * 12/1999 Stokes ..... 40/610
6,097,289 A * 8/2000 Li et al. ..... 340/531
6,717,522 B1 * 4/2004 Nagatomo et al. ..... 340/815.4
6,956,492 B2 * 10/2005 Beadman et al. ..... 340/686.1
7,183,912 B2 * 2/2007 Micko ..... 340/545.3

* cited by examiner

*Primary Examiner*—John A Tweel, Jr.

(57) ABSTRACT

A self-contained motion sensitive audio module includes a sensor circuit coupled to a pyroelectric infrared sensor with two sensing elements configured for reliably sensing passersby. The module also includes a power supply, a timing circuit, an audio circuit, a speaker and optionally an LED. The sensor circuit produces an amplified trigger signal when a passerby is sensed. The sensor circuit includes an amplifier to amplify the trigger signal. The timing circuit produces an activation signal upon receiving a trigger signal from the sensor circuit. In playback mode, the audio circuit produces an audible sign message output upon receiving an activation signal from the timing circuit. The module may be attached to the back side of a sign with apertures for receiving the sensor, speaker and optionally an LED.

19 Claims, 7 Drawing Sheets

| Part | Value | Device |
|---|---|---|
| B1, B3 | 2032 | BATTERY20 |
| C1, C2, C4 | 10 µf | NIC06H |
| C7 | 10 µf | CAP0805NP |
| C3, C5 | 0.1 µf | CAP0805NP |
| C6 | 0.01 pf | CAP0805NP |
| C8 | 4.7 µf | CAP0805NP |
| C9, C10 | 0.1 µf | NIC03H |
| D1, D2, D3, D4 | 1N914 | MMBD4148 |
| D5, D6 | LED5MM | LED5MM |
| IC1 | LM324D | LM324D |
| IC2 | LM555D | LM555D |
| Q1, Q2 | MMBT3906 | MMBT3906 |
| Q3, Q4 | MMBT3904 | MMBT3904 |
| R1, R3, R5, R10, R13, R14, R26, R27, R29, R30, R32 | 10K Ω | MCR10-0805 0805 |
| R15, R19, R20, R21, R22, R24, R25 | 1K Ω | MCR10-0805 0805 |
| R17 | 56K Ω | MCR10-0805 0805 |
| R2 | 100K Ω | MCR10-0805 0805 |
| R4, R6, R7, R8, R9, R10 | 1M Ω | MCR10-0805 0805 |
| S1 | DIP02YL | DIP02YL |
| SPK1 | SPEAKER | SPKR |
| U$1 | PIR325 | PIR02 |
| U2 | ISD1600 | ISD1600 |

FIGURE 7

MOTION SENSITIVE SELF-CONTAINED AUDIO MODULE FOR WARNING SIGNS

RELATED APPLICATION

This application claims the benefit of priority to U.S. Provisional Application No. 60/629,015 filed Nov. 18, 2004, the entire contents of which are incorporated herein and made a part hereof.

FIELD OF THE INVENTION

This invention generally relates to signs, and, more particularly, to a self-contained module configured for attachment to conventional warning signs and adapted to produce a programmed audible message upon detecting the presence of a passerby.

BACKGROUND

Warning signs (i.e., warning, hazard or caution signs) are frequently used to alert pedestrians to dangerous or harmful conditions such as a wet or slippery floor or wet paint. Typically, such signs are expendable sheet-like objects that are easy to hang and provide a clearly visible textual message. Because they are relatively inexpensive, a plurality of caution signs may be posted to cover a widespread area. While these devices are effective for warning attentive, literate passersby, they do not attract inattentive pedestrians or effectively communicate a warning message to illiterate or foreign-speaking passersby. Additionally, they are ineffective in darkened conditions (e.g., at nighttime or in a dark room).

Attempts have been made to integrate a sound emitting unit within the structure of certain signs. However, such devices have several shortcomings. They are not portable, programmable, stand alone modules that can be adapted and re-adapted to any signs. Instead, they tend to have components distributed throughout the structure of a sign. Additionally, the integrated units tend to be bulky, costly and inefficient. Consequently, such devices are not well suited for attachment to certain signs, particularly expendable sheet-like signs.

Another shortcoming of such prior devices is lack of reliability. Environmental changes tend to erroneously trigger such prior devices. Frequently, messages are played when no one is around to warn. To conserve battery power and ensure that messages are played when a passerby approaches, a more reliable device is needed.

As a consequence of the foregoing, there exists a long-standing need for a new and improved integrated audio module configured for attachment to conventional warning signs and adapted to reliably produce a programmed audible message upon detecting the presence of a passerby. The invention is directed to overcoming one or more of the problems as set forth above.

SUMMARY OF THE INVENTION

In one aspect of an exemplary embodiment of the invention, a self-contained motion sensitive audio module is provided for a sign. The module includes a sensor circuit communicatively coupled to a sensor (e.g., a pyroelectric infrared sensor with two sensing elements), a power supply operatively coupled to the sensor circuit, a timing circuit operatively coupled to the sensor circuit, and an audio circuit operatively coupled to the timing circuit. The sensor circuit is adapted to produce a trigger signal and communicate the trigger signal to the timing circuit when a sensible condition (e.g., a passerby) is sensed. The sensor circuit includes an amplifier to amplify the trigger signal. The timing circuit is adapted to produce an activation signal and communicate the activation signal to the audio circuit upon receiving a trigger signal from the sensor circuit. The audio circuit is adapted to produce an audible sign message output corresponding to an audible sign message upon receiving an activation signal from the timing circuit. The audio circuit is adapted to operate in either a recording mode or a playback mode.

The module may include one or more switches operably coupled to the module and configured to enable activation and deactivation of the module, and to enable selection between playback and record modes. A speaker operably coupled to the audio circuit is configured to produce an audible message corresponding to the audible sign message output. Optionally, an illumination device is coupled to the audio circuit and configured to produce a visible illumination during the audible sign message output. A microphone or microphone input port may optionally be coupled to the audio circuit and configured to produce a recordable audible input. A speaker operably coupled to the audio circuit emits an audible sign message based upon the audible sign message output. An illumination device, such as an LED, may optionally be coupled to the audio circuit so that the illumination device emit a visible steady or blinking light upon output of the audible sign message output.

In another aspect of an exemplary embodiment of the invention, a sign with a front side and a back side, has a message on the front side thereof. Several apertures are provided in the sign, including a sensor aperture, a speaker aperture, and (optionally) an aperture for an illumination device. A module, such as the self-contained motion sensitive audio module described above, is attached to the back side of the sign, with the sensor aligned with the sensor aperture, the speaker aligned with the speaker aperture, and optional illumination device aligned with an aperture for the illumination device.

BRIEF DESCRIPTION OF THE DRAWINGS

The foregoing and other aspects, objects, features and advantages of the invention will become better understood with reference to the following description, appended claims, and accompanying drawings, where:

FIG. 7 is a table of exemplary components for use in an exemplary motion sensitive audio module according to principles of the invention.

Those skilled in the art will appreciate that the figures are not intended to be drawn to any particular scale. The invention is not limited to the exemplary embodiments depicted in the figures or the shapes, relative sizes, proportions or materials shown in the figures.

DETAILED DESCRIPTION

Figure 1:
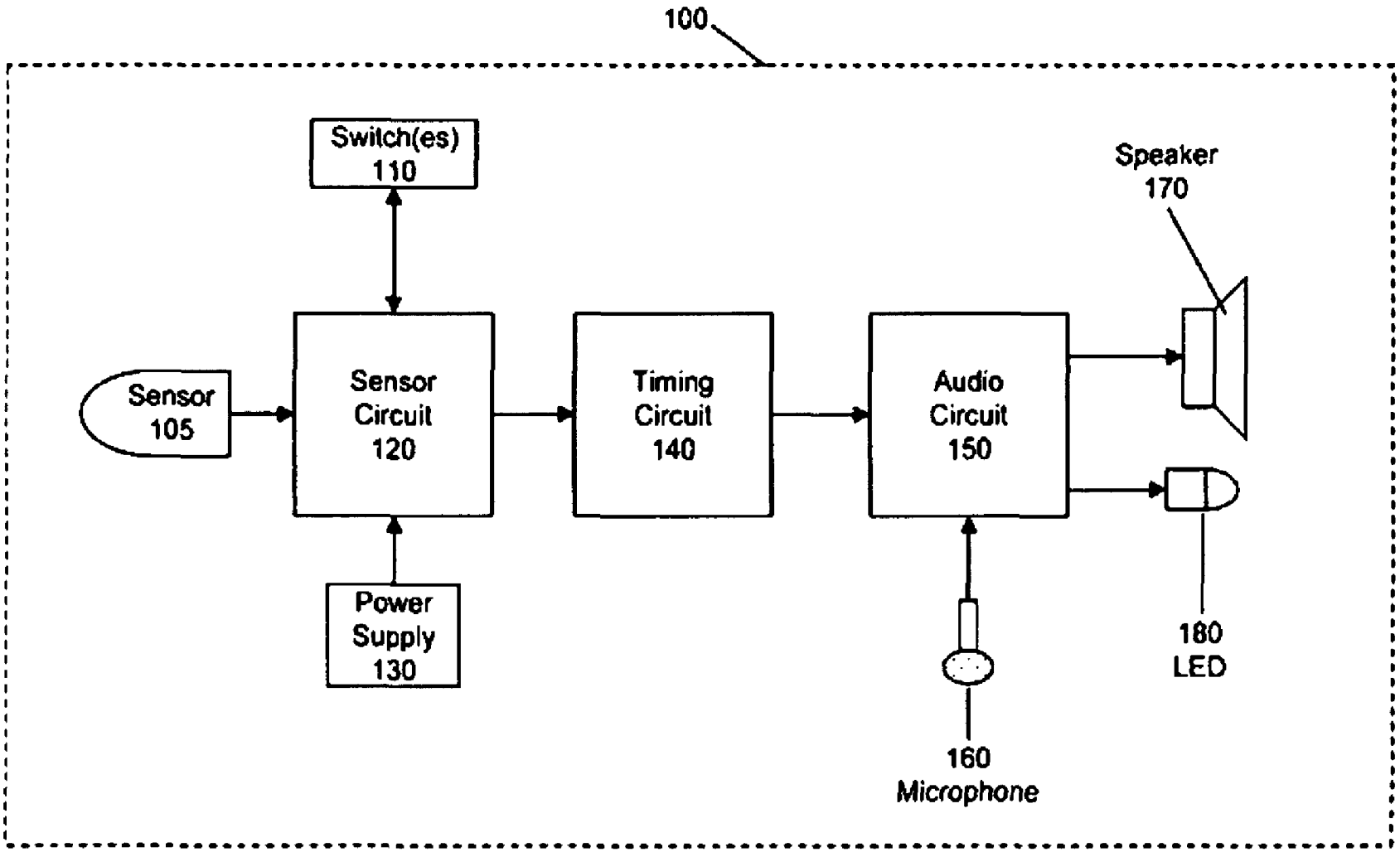
FIG. 1 is a high-level block diagram of components of an exemplary motion sensitive audio module according to principles of the invention.

The invention provides a module configured for attachment to conventional warning, caution or hazard signs and adapted to produce a programmed audible message upon detecting the presence of a passerby. Referring to FIG. 1, a block diagram of an exemplary module 100 according to principles of the invention is shown. The module includes a sensor 105, one or more switches 110, a sensor circuit 120, a power supply 130, a timing circuit 140, an audio circuit 150, an input means such as a microphone 160, a speaker 170 and a visible output 180 (e.g., illumination device) such as an LED, all operably coupled to provide functionality as described below.

Figure 2:
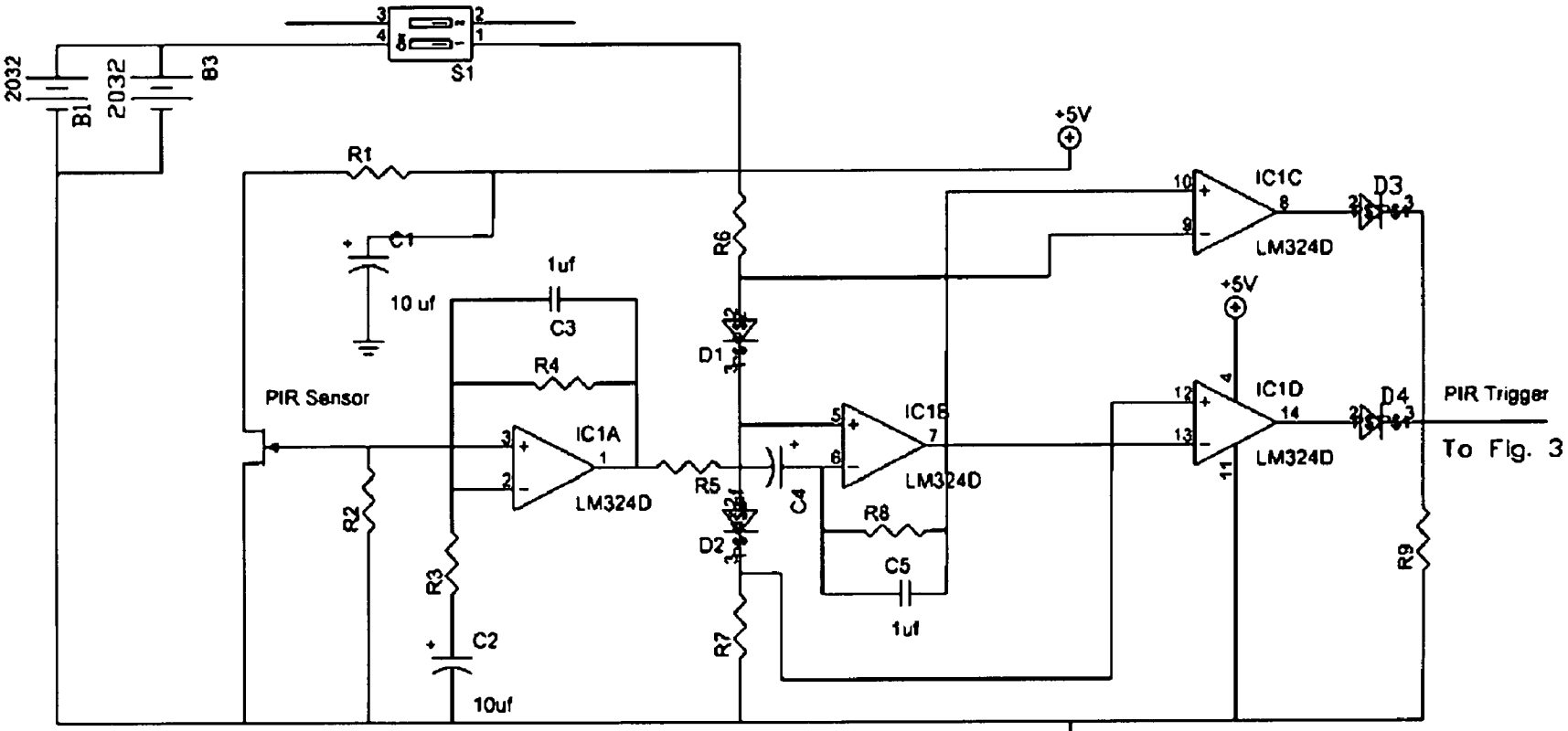
FIG. 2 is a schematic diagram of an exemplary sensor circuit having one or more sensors for use in a motion sensitive audio module according to principles of the invention.

The sensor (or sensors) 105 and corresponding circuitry shown in FIG. 2 are configured to produce a PIR Trigger signal upon detecting the presence of a nearby pedestrian. In a preferred implementation the sensor is durable enough not only to withstand outdoor weather conditions, such as heat, cold, dust, rain, sleet and snow, but also reliable enough to consistently detect the presence of a nearby pedestrian. Active and/or passive sensors may be used to react to detectable subject matter such as noise, radiation (e.g., heat), or changes in emitted energy, fields or beams. By way of example, in a preferred implementation a pyroelectric infrared (PIR) sensor is utilized. As a passive sensor, a PIR does not transmit a signal. Instead, a PIR sensor employs a pyroelectric transducer to react to infrared heat energy, such as heat energy emitted by people. The pyroelectric transducer is made of a crystalline material that generates a surface electric charge when exposed to heat in the form of infrared radiation. When the amount of radiation striking the crystal changes, the amount of charge also changes and is measured with a sensitive FET device built into the sensor. While the sensor elements may be sensitive to radiation over a wide range, a filter window may provided to limit incoming radiation to the 8 to 14 mm range, which is most sensitive to human body radiation.

In a particular preferred implementation, the sensor 105 has two sensing elements connected in a voltage bucking configuration. This arrangement cancels signals caused by vibration, temperature changes and sunlight, which simultaneously equally affect both sensing elements. However, a person passing in front of the sensor will activate first one and then the other sensing element so that the sensing elements are sequentially exposed to infrared radiation emitted by a passerby within a determined period of time.

Output from the sensor 105 is received by a sensor circuit 120. The sensor circuit is adapted to condition and amplify the sensor output signal. Referring now to FIG. 2, a multi-stage amplifier comprised of op amps. A power source B1, B3 of (e.g., 3 to 15 volts) is operably coupled to the circuit. The amplifier may be bandwidth limited to about 10 Hz to filter (i.e., reject) high frequency noise, and may be followed by a window comparator that responds to both the positive and negative transitions of the sensor output signal. The components of the exemplary sensor circuit shown in FIG. 2 are identified in the table provided as FIG. 7.

One or more switches are also operably coupled to the sensor circuit 120. By way of example and not limitation, as shown in the sensor circuit of FIG. 2, the switch may comprise a two position DIP switch, with one actuator 1-4 configured for powering/de-activating the circuit, and the other actuator 2-3 configured for selecting between playback and record modes.

The invention is not limited to a particular type of sensor or the sensor circuit of FIG. 2. Those skilled in the art will appreciate that other sensors may be used without departing from the scope of the invention. Examples of such other sensors include switches activated upon opening or closing a door or window or upon stepping upon a mat; photo electric sensors configured to detect a break in a beam of infrared light; microwave sensors that use a Gunn diode operating within pre-set limits to transmit/flood a designated area/zone with an electronic field whereby movement in the zone disturbs the field and sets off an alarm; an ultrasonic sensor configured to react to a determined range of ultrasonic sound energy in a protected area; or any other sensor capable of providing motion detection capability in accordance with principles of the invention.

Likewise, other sensor circuits may be utilized within the scope of the invention. The sensor circuit should be adapted to receive, amplify and condition output from the sensor 105 to produce a sensor circuit output (e.g., PIR Trigger) effective for use with the timing circuit 140 and audio circuit 150.

Referring again to FIG. 1, a timing circuit 140 activates the audio circuit for the duration of message playback, and prevents other PIR Triggers from interfering with the audio circuit until playback is completed. In one exemplary embodiment, the timing circuit acts in monostable mode. When a trigger voltage is applied (e.g., PIR Trigger) the output of the timing circuit goes from low to high (or inverted from high to low) for a determined duration (e.g., 7 seconds). The output from the timing circuit 140 activates the audio circuit 150 for the determined duration for playback and/or recording. In an alternative implementation, the audio circuit may respond to edges (e.g., leading edges) of output signals from a timing circuit operating in monostable or astable mode.

Figure 3:
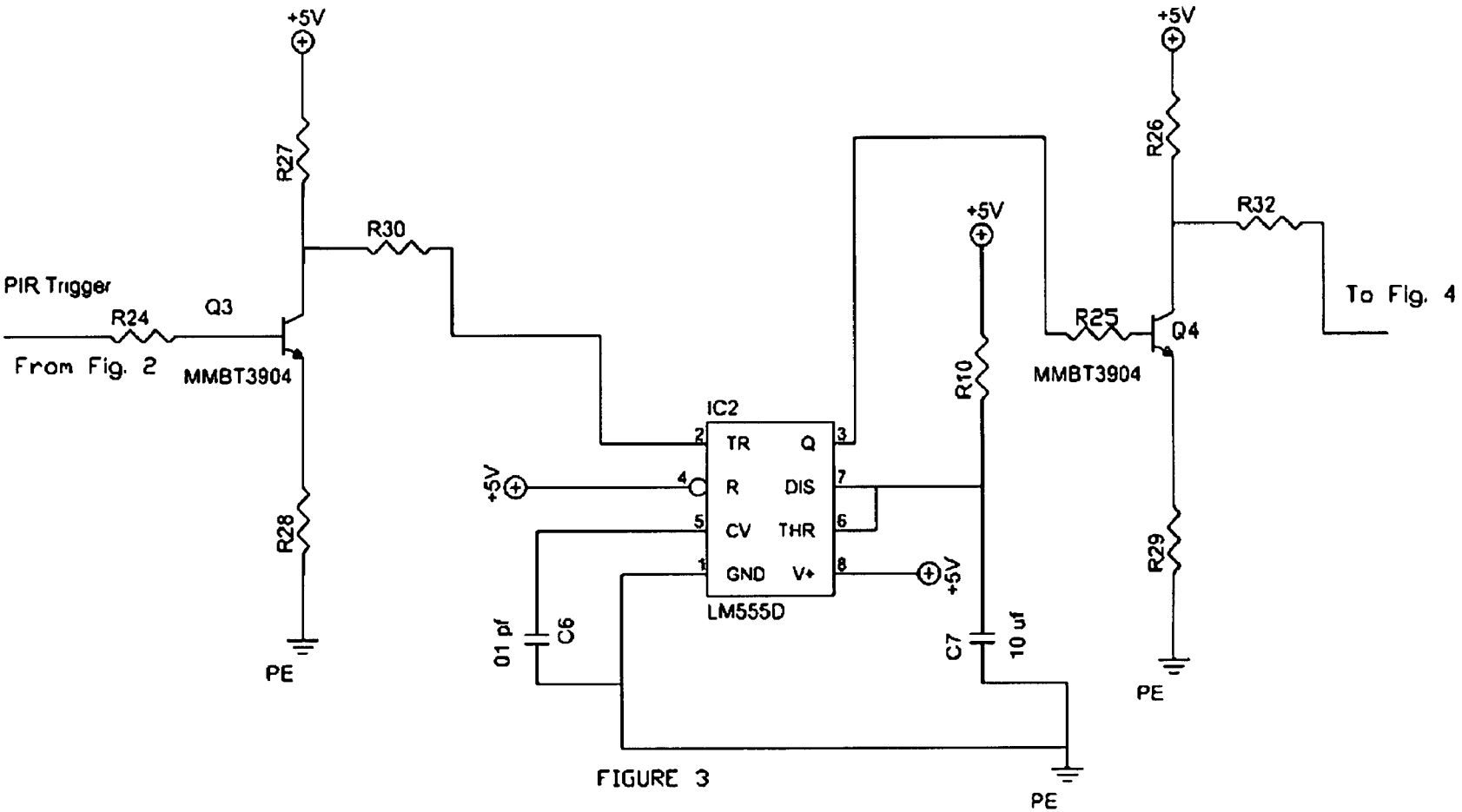
FIG. 3 is a schematic diagram of an exemplary timing circuit for use in a motion sensitive audio module according to principles of the invention.

Referring now to FIG. 3, an exemplary timing circuit includes a 555 timer (LM555D) configured in monostable mode. Pin 1 is grounded. When a trigger voltage is applied to trigger lead (pin 2), the 555 timer IC's output (pin 3) goes from low to high (which may be inverted from high to low) for a duration set by R10 and C7. A reset (pin 4) lead is coupled to the power supply. Pin 5 is grounded via a 0.01 μf bypass capacitor to help eliminate $V_{CC}$ supply noise. In the exemplary embodiment, the duration is about 7.3 seconds. However, the resistors and capacitors may be configured to provide a longer or shorter duration. In a preferred implementation, a duration of approximately 4 to 15 seconds is considered an adequate duration for playback of a typical warning message. The timer LM555D will not be re-triggered until the duration has expired. The components of the exemplary sensor circuit shown in FIG. 2 are identified in the table provided as FIG. 7.

Referring again to FIG. 1, output from the timing circuit 140 is fed to and causes the audio circuit 150 to produce analog sound signals for playing a message. The message may be pre-programmed or recorded. If the module 100 is configured to allow recording, then a microphone or microphone input jack (not shown) may (optionally) be operably coupled to the audio circuit 150 for inputting an audio message. Alternatively, the audio circuit 150 may be programmed with a message during manufacture.

Figure 4:
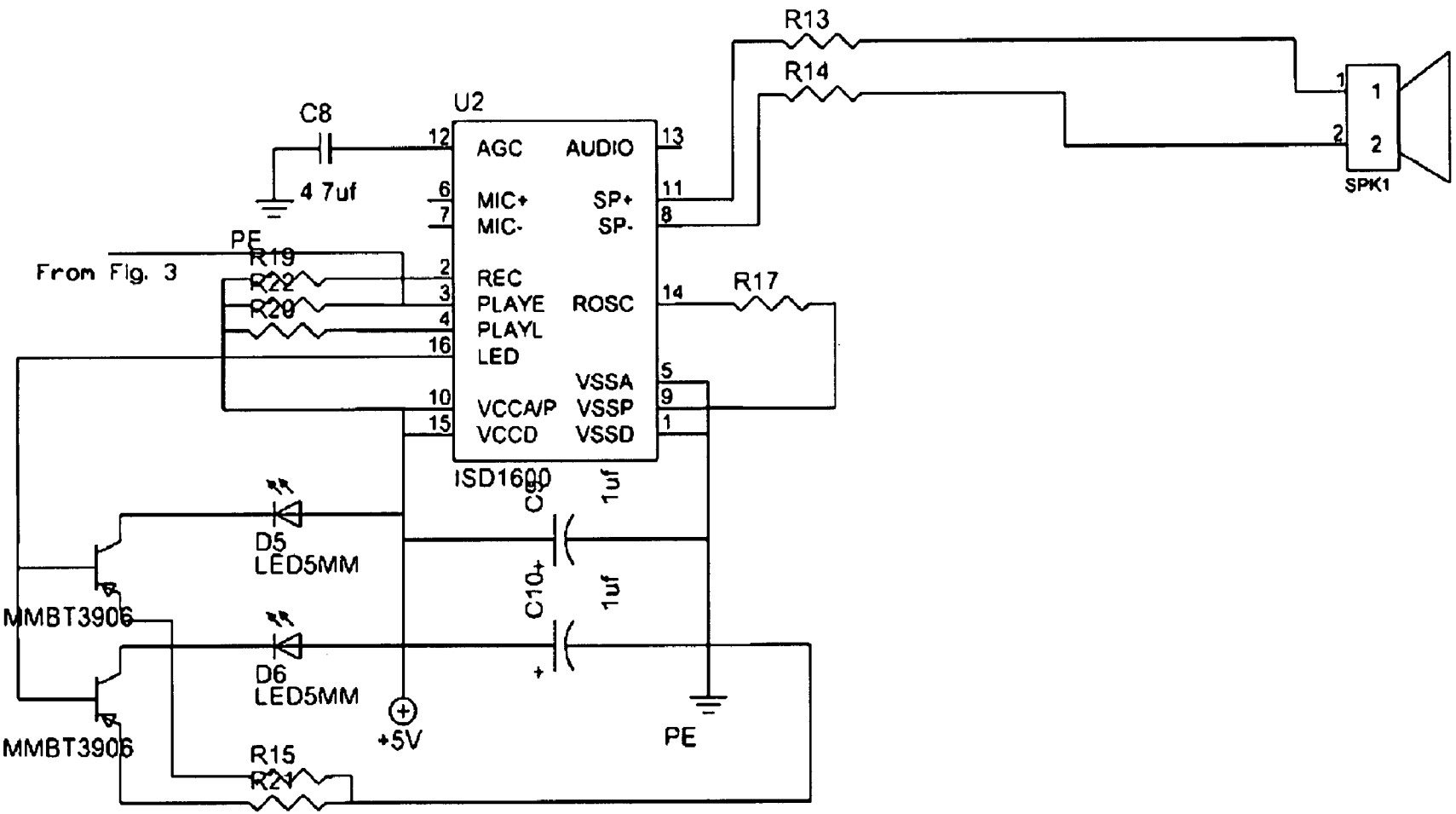
FIG. 4 is a schematic diagram of an exemplary audio circuit for use in a motion sensitive audio module according to principles of the invention.

By way of example and not limitation, an audio circuit 150 in accordance with the principles of the invention is shown in FIG. 4. The exemplary circuit shown in FIG. 4 utilizes a ChipCorder® integrated circuit by Winbond Electronics Corp., such as an ISD1600 or other ISDxxxx series ChipCorder® integrated circuit. The ISD1600 is a single chip, single-message, record/playback integrated circuit with user-selectable durations of about 6.6 to 40 seconds. It provides low power operation, and non-volatile message storage using solid-state memory. It includes an on-chip oscillator (with external control), microphone preamplifier, automatic gain control, anti-aliasing filter, multilevel storage array, smoothing filter, and speaker amplifier. Operating voltage spans from a range of 2.4 to 5.5 V. Recordings are stored into on-chip Flash memory cells, providing zero-power message storage. Those skilled in the art will appreciate that other sound generation circuits may be used in lieu of the circuit shown in FIG. 4 without departing from the scope of the invention.

In the exemplary embodiment of FIG. 4, pin 1 is digital ground terminal, pin 5 is an analog ground terminal and pin 9 is a ground terminal for the speaker driver. Pin 2, which is operably coupled to the switch S1 (2-3), controls initiation of recording. Pins 3 and 4 respectively provide edge trigger and level trigger playback, respectively. Edge trigger playback responds to a leading edge of a PIR Trigger signal to initiate playback, while level trigger responds to the entire PIR Trigger signal. Pins 6 and 7 are microphone inputs. Pin 10 is an analog/speaker power supply terminal. Pin 15 is a digital power supply terminal. Pin 12 is an automatic gain control (AGC) terminal. The AGC dynamically adjusts the gain of preamplifier circuitry within the chip to compensate for a range of microphone input levels. A value of 4.7 μF provides satisfactory results for message input using a conventional microphone. Connecting pin 12 to the ground provides maximum gain. The Speaker output from pins 8, 11 can directly drive a standard 8 Ω speaker SPK1 or a buzzer. A pair of variable resistors R13, R14 are disposed therebetween to enable regulation of speaker SPK1 volume. Pin 13, which is not used in the exemplary implementation, provides output to drive an optional external audio amplifier. Pin 14 is an oscillator resistor terminal which controls the record and playback duration of the device. A resistor R17 having resistance of approximately 60 Ω (e.g., 56K Ω) provides approximately a 6.6 second duration. Pin 16 is an LED output terminal, which is low during a record cycle and blinks during playback. It can be configured to drive one or more LEDs D5, D6, to indicate either a record or playback cycle is in progress. The components of the exemplary sensor circuit shown in FIG. 2 are identified in the table provided as FIG. 7.

As discussed above, the speaker 170 is operably coupled to the audio circuit 150. The speaker 170 may either be mounted to the module or free to be mounted elsewhere. The speaker 170 is configured to produce audio output based on signals produced from the audio circuit 150.

Also as discussed above, one or more LEDs 180 may be operably coupled to the audio circuit 150. The LEDs 180 may either be mounted to the module or free to be mounted elsewhere. The LEDs 180 may be configured to produce visual output (e.g., steady or blinking light) to indicate status of the audio circuit 150.

Optionally, a microphone 160 (e.g., an electret microphone) may be integrated with the module to feed voice signals into the audio circuit during recording. Alternatively, one or more microphone jacks may be provided for operably connecting an external microphone as needed. As another alternative, the audio circuit 150 may be pre-programmed with a recorded or machine-generated message for playback. The audio circuit 150 includes a microphone input (pins 6, 7), a decoder and nonvolatile memory (e.g., within the integrated circuit ISD1600). The microphone input is configured to receive signals corresponding to an audible sign message. The nonvolatile memory is configured to store the audio signals, or data corresponding to the audio signals. The decoder is configured to controllably convert the stored signals (or data) corresponding to an audible sign message output for amplification and output to a speaker.

The power supply 130 may include one or more small batteries, such as one or more watch-size, AAA or other compact batteries. The various components of the module 100 determine an appropriate amperage and voltage for the power supply.

Optionally, the module 100 (or a kit containing the module 100) may include attachment means configured for attaching the module to a sign and/or to a wall or similar structure. The attachment means may include an adhesive, glue, bonding agent, epoxy, mechanical fasteners, hook and loop tape strips, tape or any other means for securing the module 100 to a sign. Alternatively, the module may be contained in a compartment or secured in a holder formed as part of the sign.

Optionally, a housing or other protective enclosure may be provided for the module 100. In one exemplary implementation, the module may be securely contained within a housing in the form of a hexahedron enclosure, an envelope or pocket formed from cardboard, plastic or other suitable material.

Figure 6:
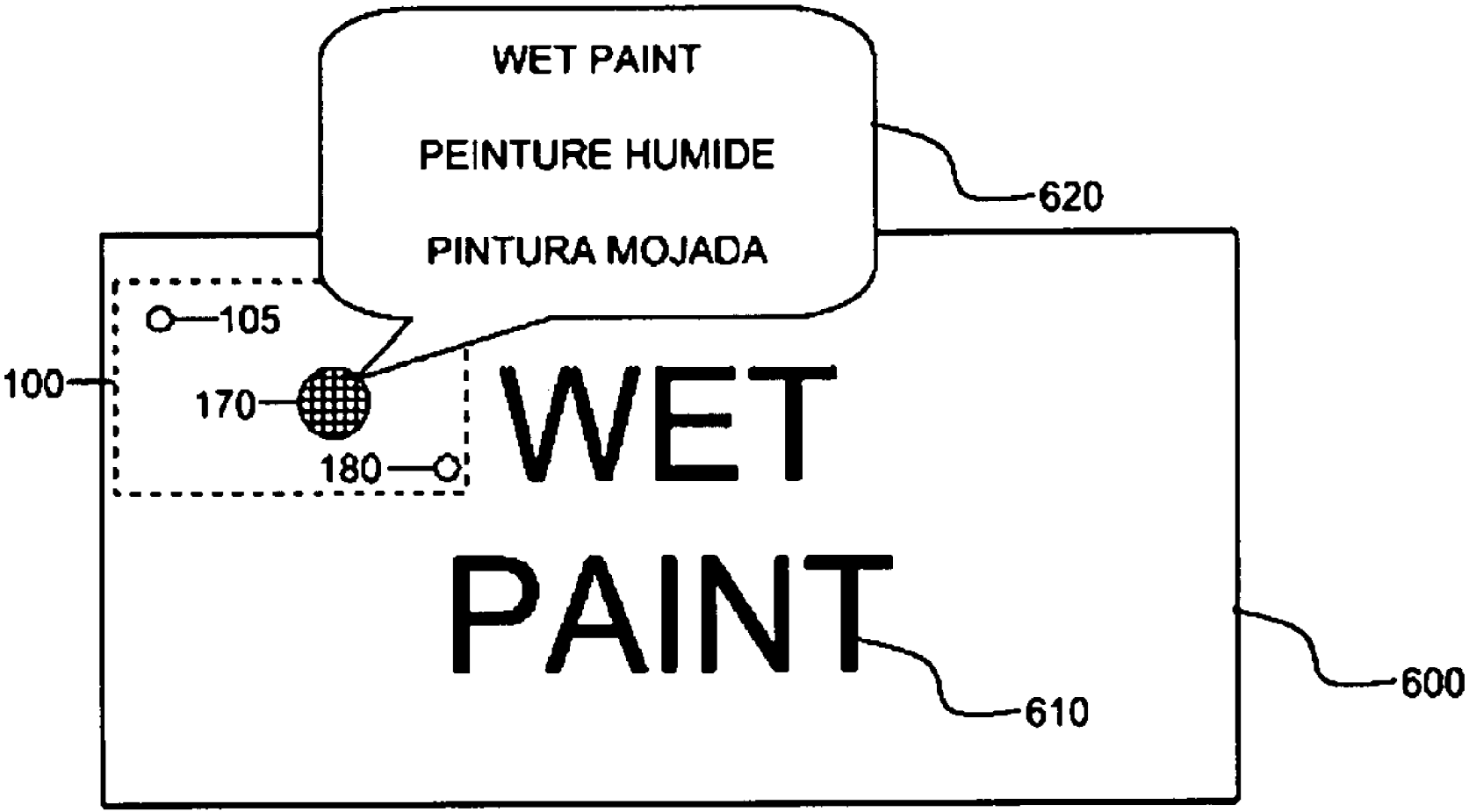
FIG. 6 is a plan view diagram of a sign equipped with a motion sensitive audio module according to principles of the invention.

Referring now to FIG. 6, in use, the module 100 may be attached to a sign 600 or located adjacent to a sign 600 and attached to or hung on a structure such as a wall. Clips, adhesives, glue, bonding agents, hangers, and/or hook and loop fasteners may be provided for such attachments. If the module is attached to the backside of a sign, as conceptually shown in FIG. 6, apertures may be formed in the sign to accommodate the sensor 105, speaker 170 and any LEDs 180. When the sensor 105 detects a condition consistent with the presence of a nearby pedestrian, the module 100 is activated to produce sound signals for a recorded warning message. The sound signals activate the speaker 170, which projects an audible message. The message may include statements in any of various languages to communicate in a native language and/or one or more foreign languages. The message may be comprised of generic terms such as "Caution Wet Paint," "Caution Wet Floor" and/or any recordable sounds, such as a siren sound.

Figure 5:
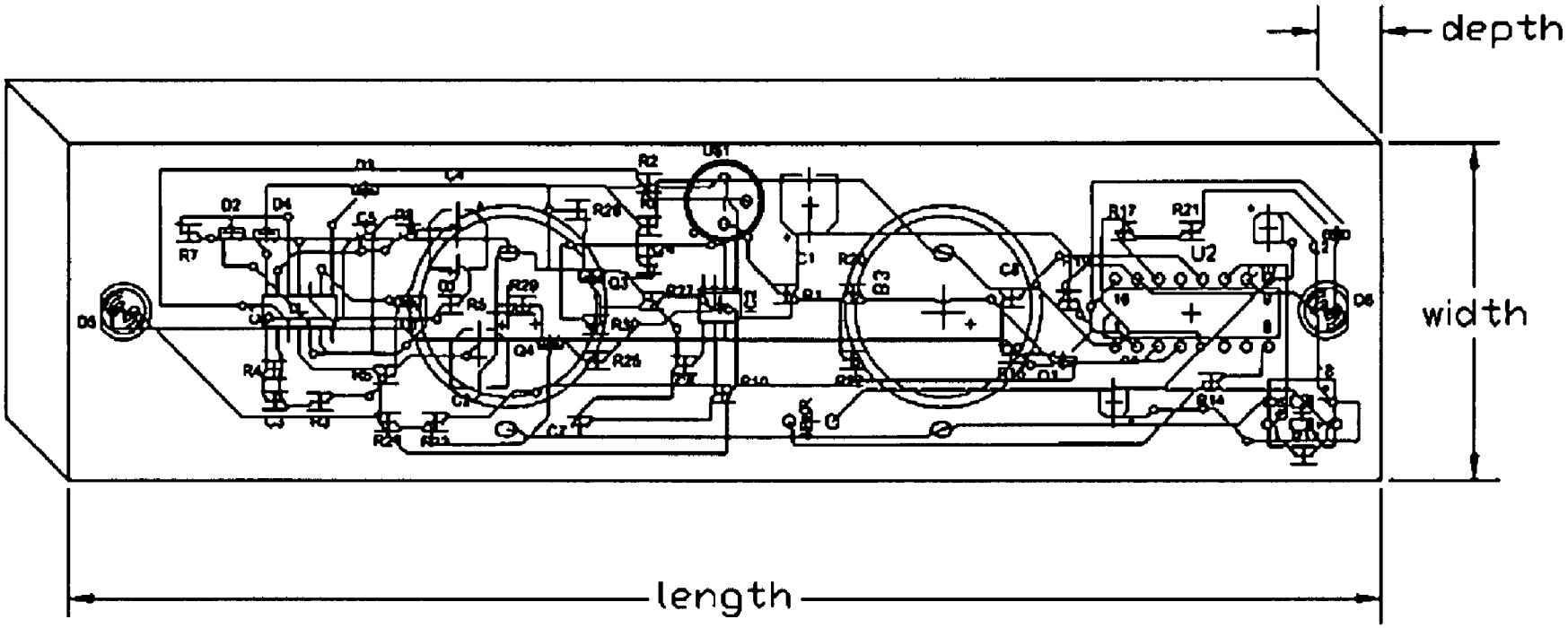
FIG. 5 is a schematic of a PCB embodiment of an exemplary motion sensitive audio module according to principles of the invention.

Advantageously, a module 100 according to principles of the invention provides a self-contained (i.e., constituting a complete and independent unit in and of itself), compact, customizable, lightweight, inexpensive, motion-activated audio module that may be attached to and/or used in connection with any signs. Referring to FIG. 5, which conceptually illustrates a printed circuit board (PCB) embodiment of an exemplary module 100 according to principles of the invention, the module may (for example) be approximately 0.5 to 4.0 inches in length, 0.5 to 2.0 inches in width, and 0.25 to 1.0 inches in depth, depending upon the selection, arrangement and configuration of components.

Any audible message/sound may be recorded for playback, within the duration limits of the module. Thus, manufacturers may pre-record messages for playback, or an end-user may customize the module by recording his/her own message for playback. The message may include statements in any of various languages to communicate in a native language and/or one or more foreign languages. Thus, illiterate and foreign passersby may be audibly alerted to a condition denoted by the sign.

Because the module 100 is relatively inexpensive, it may be treated as an expendable component. Alternatively, the module may be reused, and the batteries can be replaced, as desired.

The module 100 is extremely versatile. It may be sold separately or with a sign, as an integral part of a sign or as a separate component. Using the module 100, any conventional sign may readily be adapted to produce audio output using the module.

While the invention has been described in terms of various embodiments, implementations and examples, those skilled in the art will recognize that the invention can be practiced with modification within the spirit and scope of the appended claims including equivalents thereof. The foregoing is considered as illustrative only of the principles of the invention. Variations and modifications may be affected within the scope and spirit of the invention.

What is claimed is:

1. A self-contained motion sensitive audio module for a sign modified by forming an aperture sized to accommodate a sensor, said module comprising a sensor circuit communicatively coupled to a sensor, a power supply operatively coupled to the sensor circuit, a timing circuit operatively coupled to the sensor circuit, an audio circuit operatively coupled to the timing circuit, said sensor circuit being adapted to produce a trigger signal and communicate said trigger signal to the timing circuit when a sensible condition is sensed, said timing circuit being adapted to produce an activation signal and communicate said activation signal to the audio circuit upon receiving a trigger signal from the sensor circuit, said audio circuit being adapted to produce an audible sign message output corresponding to an audible sign message upon receiving an activation signal from said timing circuit, said module being smaller in length and width than the sign and attachable to the back of the sign, said timing circuit being configured in monostable mode and said audio circuit being configured to produce the audible sign message output for the lesser of the duration of the activation signal or the duration of the audible sign message.

2. A self-contained motion sensitive audio module according to claim 1, said module further comprising a switch operably coupled to the module and configured to enable activation and deactivation of the module.

3. A self-contained motion sensitive audio module according to claim 1, said module further comprising a switch operably coupled to the module and configured to enable selection of a mode of operation from the group consisting of a recording mode and a playback mode.

4. A self-contained motion sensitive audio module according to claim 1, said module further comprising a speaker operably coupled to the audio circuit and configured to produce an audible message corresponding to the audible sign message output.

5. A self-contained motion sensitive audio module according to claim 1, said module further comprising an illumination device operably coupled to the audio circuit and configured to produce a visible illumination during the audible sign message output.

6. A self-contained motion sensitive audio module according to claim 1, said module further comprising a microphone operably coupled to the audio circuit and configured to produce a recordable audible input, said audio circuit being adapted to operate in a selectable mode of operation from the group consisting of a recording mode and a playback mode.

7. A self-contained motion sensitive audio module according to claim 1, said sensor comprising a pyroelectric infrared sensor.

8. A self-contained motion sensitive audio module according to claim 7, said pyroelectric infrared sensor comprising at least two sensing elements connected in a configuration whereby the sensing elements produce a sensor signal are sequentially exposed to infrared radiation emitted by a passerby.

9. A self-contained motion sensitive audio module according to claim 8, said pyroelectric infrared sensor comprising at least two sensing elements connected in a configuration that produces a sensor signal output when the sensing elements are sequentially exposed to a sensible condition within a determined period of time, said sensor circuit producing a trigger signal in response to the sensor signal output.

10. A self-contained motion sensitive audio module according to claim 1, said sensor circuit including an amplifier and said trigger signal being a signal amplified by said amplifier.

11. A self-contained motion sensitive audio module for a sign modified by forming an aperture sized to accommodate a sensor, said module comprising a sensor circuit communicatively coupled to a sensor, a power supply operatively coupled to the sensor circuit, a timing circuit operatively coupled to the sensor circuit, an audio circuit operatively coupled to the timing circuit, said sensor circuit being adapted to produce a trigger signal and communicate said trigger signal to the timing circuit when a sensible condition is sensed, said timing circuit being adapted to produce an activation signal and communicate said activation signal to the audio circuit upon receiving a trigger signal from the sensor circuit, said audio circuit being adapted to produce an audible sign message output corresponding to an audible sign message upon receiving an activation signal from said timing circuit, said module being smaller in length and width than the sign and attachable to the back of the sign, said timing circuit being configured in a stable mode and said audio circuit being configured to produce the audible sign message output upon receiving a leading edge of the activation signal, said audible sign message output being produced for the duration of the audible sign message.

12. A self-contained motion sensitive audio module according to claim 1, said audio circuit being configured to respond to a leading edge of the activation signal.

13. A self-contained motion sensitive audio module according to claim 1, said audio circuit being configured to respond to the activation signal.

14. A self-contained motion sensitive audio module according to claim 1, said module further comprising a speaker operably coupled to the audio circuit, said speaker being configured to emit an audible sign message based upon the audible sign message output.

15. A self-contained motion sensitive audio module according to claim 1, said module further comprising an illumination device operably coupled to the audio circuit, said illumination device being configured to emit a visible light upon output of the audible sign message output.

16. A self-contained motion sensitive audio module according to claim 1, said audio circuit further comprising a microphone input, an amplifier and a nonvolatile memory, said microphone input being configured to receive signals corresponding to an audible sign message, said nonvolatile memory being configured to store data corresponding to said signals, and a decoder being configured to produce audible sign message output signals corresponding to said data corresponding to said signals.

17. A sign having a front side and a back side, and further including a message on the front side of the sign, a sensor aperture, a speaker aperture, and an self-contained motion sensitive audio module attached to the back side, said module being smaller in length and width than the sign, said module comprising a sensor circuit communicatively coupled to a sensor, a power supply operatively coupled to the sensor circuit, a timing circuit operatively coupled to the sensor circuit, an audio circuit operatively coupled to the timing circuit, and a speaker operatively coupled to the audio circuit, said sensor circuit being adapted to produce a trigger signal and communicate said trigger signal to the timing circuit when a sensible condition is sensed, said timing circuit being adapted to produce an activation signal and communicate said activation signal to the audio circuit upon receiving a trigger signal from the sensor circuit, said audio circuit being adapted to produce an audible sign message output corresponding to an audible sign message upon receiving an activation signal from said timing circuit, said sensor being aligned with the sensor aperture, and said speaker being aligned with the speaker aperture, said timing circuit being configured in monostable mode and said audio circuit being configured to produce the audible sign message output for the lesser of the duration of the activation signal or the duration of the audible sign message.

18. A sign according to claim 17, further comprising a light aperture, and wherein said self-contained motion sensitive audio module further includes an illumination device configured to illuminate during playback, said illumination device being aligned with the light aperture.

19. A sign according to claim 17, wherein the audible sign message is a message in a plurality of languages.

* * * * *